United States Patent [19]

Lecinski

[11] Patent Number: 4,576,296

[45] Date of Patent: Mar. 18, 1986

[54] COMBINATION RADIAL LOCKING DEVICE AND INFESTATION SEAL FOR PRESS-SEAL TYPE TRANSFER NECK FINISH

[75] Inventor: Frank H. Lecinski, Harwood Heights, Ill.

[73] Assignee: Continental White Cap, Inc., Northbrook, Ill.

[21] Appl. No.: 719,119

[22] Filed: Apr. 2, 1985

[51] Int. Cl.[4] ..... B65D 41/04

[52] U.S. Cl. ..... 215/31; 215/274; 215/335; 220/319

[58] Field of Search ..... 215/31, 274, 335; 220/319

[56] References Cited

U.S. PATENT DOCUMENTS

| | | | |
|---|---|---|---|
| 806,602 | 12/1905 | Uhl . | |
| 2,443,086 | 6/1948 | Turenne . | |
| 3,141,586 | 7/1964 | Wetterek . | |
| 3,603,472 | 9/1971 | Lecinski et al. | 215/31 X |
| 4,066,182 | 1/1978 | Allen | 215/256 |

*Primary Examiner*—Donald F. Norton
*Attorney, Agent, or Firm*—Charles E. Brown

[57] ABSTRACT

This relates to a press-seal type transfer neck finish for a container wherein the neck finish is provided with an annular recess into which there is snapped a fitment which carries the thread elements for a threaded closure. In order to facilitate closing of a container which has been filled with the product to be packaged, the closure is assembled with a fitment having thread elements cooperating with the thread of the closure. Thus the resultant closure unit may be applied to the container by merely downwardly pressing the closure unit onto the container. In the formation of the fitment thread elements, openings are formed in a lower flange of the fitment through which tiny insects and foreign matter may enter into the space between the closure skirt and the fitment. These openings are sealed by fin segments or flaps molded in one piece with the fitment and being swingable to underlie the fitment flange in sealed relation in alignment with the openings. Also the bead of the container neck finish is provided with recessed seats to receive in interlocking relation the fin segments or flaps to lock the fitment against rotation relative to the container neck finish.

12 Claims, 4 Drawing Figures

COMBINATION RADIAL LOCKING DEVICE AND INFESTATION SEAL FOR PRESS-SEAL TYPE TRANSFER NECK FINISH

This invention relates in general to new and useful improvement in closure units for containers, and more particularly to a closure unit of the type wherein the container neck finish is provided with an annular recess and the closure is combined with a fitment having external threads for interlocking with a closure element and wherein the fitment has a snap fit with the container neck finish. Such a closure unit is disclosed in U.S. Pat. No. 3,603,472 to Lecinski et al.

When the fitment is provided with thread segments, the undersides of the thread segments or elements are defined in the molding die by blade like elements. These blade like elements result in openings in the bottom flange of the fitment. These openings can allow tiny insects to enter up into the neck finish thread area.

In accordance with this invention, these openings or passageways are closed by a vertical fin segment or flap which is molded below and radially inwardly of each by-pass opening. Each segment or flap can be a single piece or a row of several fins end to end. An integral hinge is molded into the base of each segment or flap so it is able to be folded radially outwardly to shut off the respective by-pass opening.

In addition, the container neck finish, which is provided with a radially outwardly directed bead at the bottom of the annular recess may be provided with slight depressions or seats for receiving the fin segments or flaps in interlocking relation. This will prevent rotation of the fitment with respect to the container neck finish.

With the above and other objects in view that will hereinafter appear, the nature of the invention will be more clearly understood by reference to the following detailed description, the appended claims, and the several views illustrated in the accompanying drawings.

Figure 1:
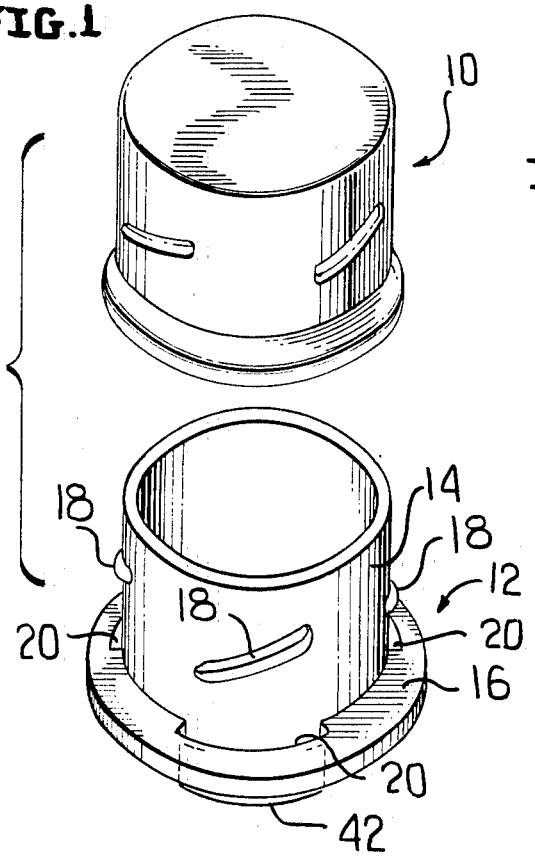
FIG. 1 is an exploded top perspective view showing a fitment formed in accordance with this invention and a closure cap which is to be associated therewith.

Referring now to the drawings in detail, reference is first made to FIG. 1 in which there is illustrated a conventional closure cap, generally identified by the numeral 10, and a fitment, generally identified by the numeral 12, the fitment being formed in accordance with this invention. The fitment 12 includes a tubular member 14 which is provided at its lower end with a radially outwardly directed flange 16. The tubular member has projecting radially outwardly from an upper portion thereof thread segments or elements 18.

It is to be understood that the fitment 12 is injection molded in a suitable die or mold and that in order to form the underside of each of the thread elements 18, the die is provided with a blade like member which must extend through that portion of the die or mold which defines the flange 16. Thus the flange 16 is provided with a by-pass opening 20 therethrough in axial alignment with each thread element 18.

It is to be understood that the closure 10 will be provided with internal threads (not shown) by way of which the closure 10 may be interlocked with the fitment 12.

Customarily the closure 10 will be secured on the fitment 12 and then the closure which is formed of the closure 10 and the fitment 12 will then be press fitted onto the container which has been filled with the product to be packaged.

Figure 2:
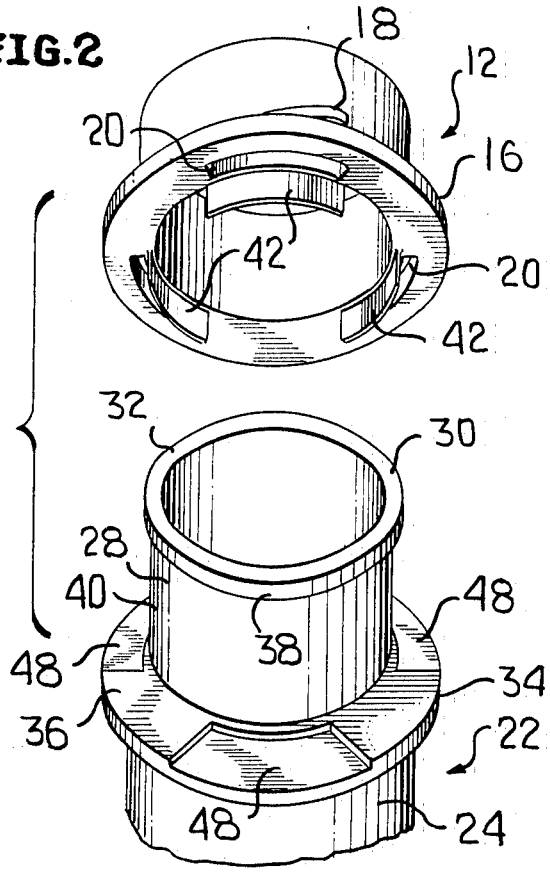
FIG. 2 is an exploded perspective view showing the underside of the fitment and the neck finish of the container for receiving the fitment.

Reference is now made to FIG. 2 wherein there is illustrated an upper portion of a container which is generally identified by the numeral 22. The container 22 includes a neck portion 24 which terminates in a neck finish generally identified by the numeral 26.

The neck finish 26 includes a generally cylindrical neck element 28 which has projecting from the upper end a radially outwardly directed bead or flange 30. The bead or flange 30 has an upper surface 32 which is a sealing surface to be engaged by the closure 10 in a normal manner to seal the container 22.

Between the neck member 28 and the neck 24 the container 22 includes a radially outwardly directed bead 34. An upper surface of the bead 34 defines a lower shoulder 36 while an undersurface of the bead 30 defines an upper shoulder 38 which opposes the lower shoulder 36. The neck finish 26, between the shoulders 36, 38 defines an annular recess 40 which generally surrounds the neck portion 28.

Figure 3:
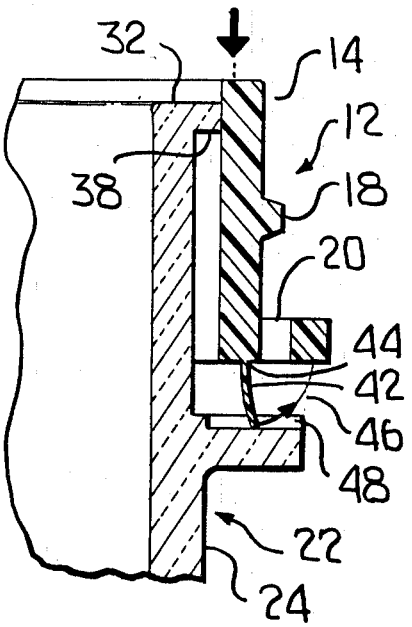
FIG. 3 is an enlarged fragmentary sectional view showing the fitment as it is being forced over the container neck finish.

In FIG. 3 there is illustrated the fitment 12 being assembled with the container neck finish 26. It is to be understood, however, that the fitment 12 should be carrying the closure 10 at this time but the closure 10 has been omitted for purposes of clarity.

Inasmuch as the fitment 12 is molded of a resilient plastic material and while normally the container 22 will be formed of a rigid material, such a glass, it will be seen that the fitment 12 may be forced down over the bead 30 in the manner shown. At this time it is pointed out that the spacing between the shoulders 36 and 38 corresponds generally to the axial dimension of the tubular member 14 of the fitment 12. Thus when the fitment 12 is fully telescoped over the neck finish 26, it will generally engage both shoulders 36, 38 so as to be axially fixed relative to the container 22.

The combination as thus described has two deficiencies. First the by-pass openings 20 remain open so that small insects and the like may pass through the openings 20 up between the tubular member of the fitment 12 and the skirt of the closure cap 10. Other foreign matter in a like manner may enter into the same space through the openings 20.

Secondly, there is nothing to restrain the fitment 12 against rotation relative to the container 22. Thus when one attempts to remove the closure 10 by rotating the same in the normal manner, the fitment may remain interlocked with the closure so as to prevent separation of the two and thus prevent opening of the container 22.

In accordance with this invention, two changes have been made in the fitment and the container over the known prior art. First of all, there has been molded in one piece with the tubular member 14 a fin segment or flap 42 for each of the openings 20. Each flap 42 is preferably relatively thin and is arcuate in outline as is shown in FIG. 2. Further, the connection between each flap 42 and the bottom end of the tubular member 14 is in the form of a hinge line 44 to faciliate the folding of the flap relative to the tubular member.

Although a separate flap for each of the openings 20 has been provided, and the flaps 42 are circumferentially spaced, the fins or flaps may be arranged as a row of several fin segments or flaps disposed in end-to-end relation.

Figure 4:
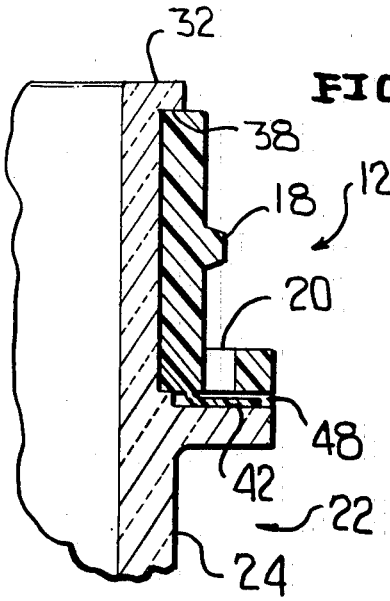
FIG. 4 is a fragmentary sectional view similar to FIG. 3 showing the fitment fully in place with the fin segments or flaps closing the openings in the fitment flange.

Referring now once again to FIGS. 3 and 4, it will be seen that when the fitment 12 is pressed down onto the container neck finish 26, the flaps 42 will engage the shoulder 36 and will swing or hinge radially outwardly as shown by the arrow 46 in FIG. 3. As the fitment 12 is pressed to its final position, each flap 44 will have swung to a position at right angles to the axis of the fitment 12 and will be compressed between the underside of the flange 16 and the shoulder 36. Thus the openings 20 will automatically be closed.

The fin segments or flaps 42 may have a second function. As is best shown in FIG. 2, the upper surface of the bead 34 may be provided with a plurality of circumferentially extending seats 48. Each seat 48 is arcuate in outline and will be of a size to receive an associated one of the flaps 42. It is to be noted that the seats 48 are formed in the shoulder 36.

Thus when the closure unit is applied to the container 22 and rotated slightly, the fin segments or flaps 42 will drop into the recess seats 48 and become interlocked with the bead 34. The remote ends 50 of each flap 42, in combination with the ends of the associated seat 48, will function as stop means to limit the rotation of the fitment 12 relative to the neck finish 26. Thus the fin segments or flaps 42 function as combination radial locking devices and infestation seal means.

Although only a preferred embodiment of the invention has been specifically illustrated and described herein, it is to be understood that minor variations may be made in the fitment and its relationship to the container neck finish without departing from the spirit and scope of the invention as defined by the appended claims.

I claim:

1. A fitment for adapting a container neck finish to receive a threaded closure, said fitment comprising a tubular member having a lower radially outwardly directed flange, circumferential thread elements projecting radially outwardly from said tubular member axially above said flange, circumferential openings in said flange in axial alignment with said thread elements for receiving thread element molding blades, and depending flap means for underlying said flange in axial alignment with said openings and in sealing contact with said flange to sealingly close said openings.

2. A fitment according to claim 1 wherein each of said flap means is directly connected to a lower end of said tubular member.

3. A fitment according to claim 1 wherein each of said flap means is molded in one piece with said tubular member.

4. A fitment according to claim 1 wherein each of said flap means is in depending relation, and each of said flap means is swingable radially outwardly to underlie said flange.

5. A fitment according to claim 1 wherein each of said flap means has circumferentially remote ends defining lock means for cooperation with a container neck finish to prevent rotation of said fitment relative to such container neck finish.

6. A fitment according to claim 1 together with a container neck finish said container neck finish having an outer annular recess receiving said fitment tubular member, said recess being defined at ends thereof by upper and lower shoulders opposing opposite ends of said tubular member and locking said tubular member against axial movement relative to said container neck finish, and said lower shoulder having recessed seats therein receiving said flap means in interlocking relation to prevent rotation of said fitment relative to said container neck finish.

7. A fitment and container neck finish according to claim 6 wherein said lower shoulder is in part defined by a radially outwardly directed head, and said seats being at least in part formed in said head.

8. A fitment and container neck finish according to claim 7 wherein said seats in part underlie said tubular member.

9. A fitment and container neck finish according to claim 1 wherein each of said flap means is directly connected to a lower end of said tubular member.

10. A fitment and container neck finish according to claim 1 wherein each of said flap means is directly connected to a lower end of said tubular member in depending relation, and each of said flap means is swingable radially outwardly to underlie said flange.

11. A fitment and container neck finish according to claim 6 wherein said flap means and said seats are arcuate in outline.

12. In a container, a tubular neck portion, said tubular neck portion having a neck finish including an outer annular recess for receiving a tubular member of a fitment, said recess being defined at ends thereof by upper and lower shoulders for opposing opposite ends of such a fitment tubular member, and said lower shoulder having recessed seats therein for receiving in interlocking relation flap means of a fitment.

* * * * *